United States Patent [19]

Kelson

[11] 4,413,800

[45] Nov. 8, 1983

[54] TRASH BAG CADDY

[76] Inventor: Arthur F. Kelson, 11701 Foster Rd., Los Alamitos, Calif. 90720

[21] Appl. No.: 379,646

[22] Filed: May 19, 1982

[51] Int. Cl.[3] ..... B65B 67/04

[52] U.S. Cl. ..... 248/99

[58] Field of Search ..... 248/97, 95, 101, DIG. 7, 248/150, 165; 220/401, 403, 404

[56] References Cited

U.S. PATENT DOCUMENTS

| | | | |
|---|---|---|---|
| 2,030,775 | 2/1936 | Twiss | 248/150 |
| 3,866,872 | 2/1975 | Burgess | 248/101 X |
| 4,283,032 | 8/1981 | Smith | 248/101 X |
| 4,312,489 | 1/1982 | Paetzold | 248/99 X |

*Primary Examiner*—Ramon S. Britts
*Assistant Examiner*—Sarah A. Lechok
*Attorney, Agent, or Firm*—Roger A. Marrs

[57] ABSTRACT

A trash bag caddy is disclosed herein having a rigid hoop and rod base therefore for supporting and holding the entrance of a trash bag open to receive leaves, trash, debris or the like. The bag is composed of pliable, resilient material adapted to be folded over the hoop. The rod base includes a pair of U-shaped leg members arranged normal to each other having their free ends detachably secured to the hoop by snap-lock fasteners. A circular snap-lock fastener detachably secures overlapping portions of the leg members together to maintain the leg members substantially at right angles to each other.

7 Claims, 10 Drawing Figures

FIG. 3
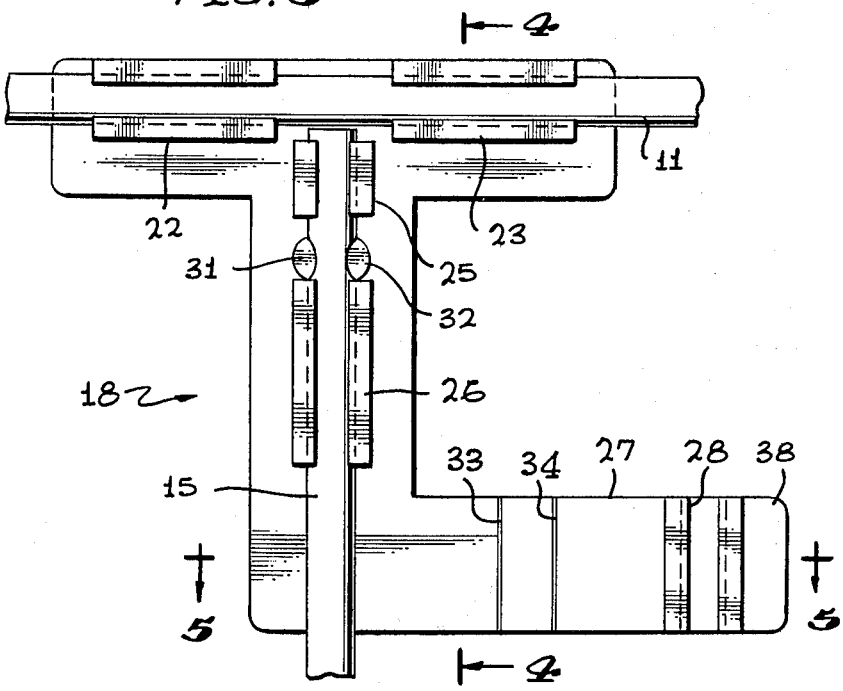
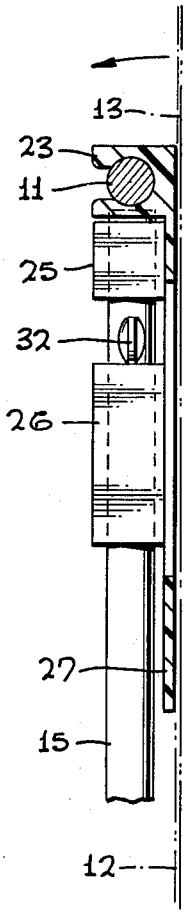
FIG. 4
FIG. 5
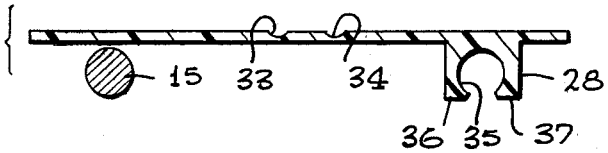
FIG. 6
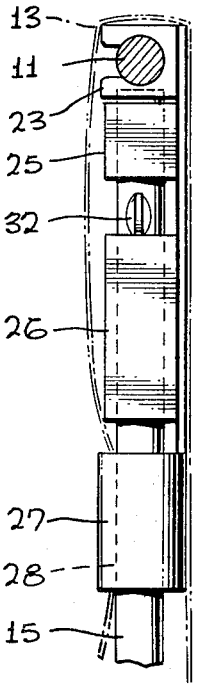
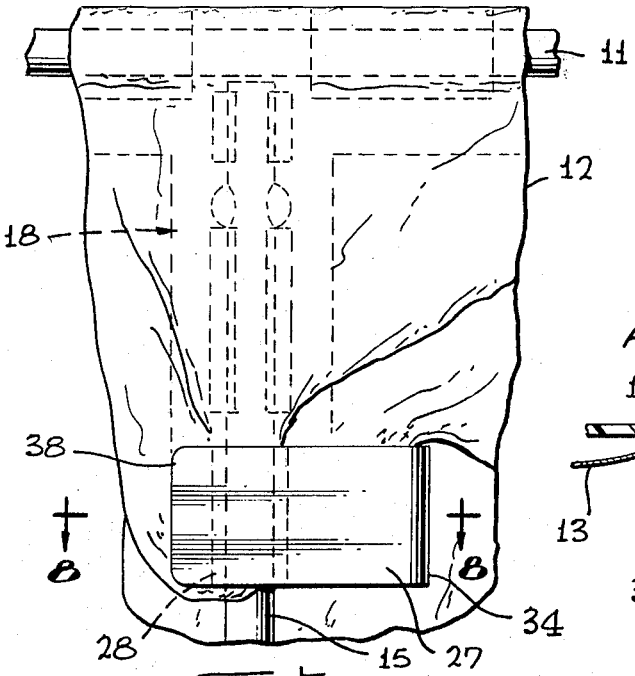
FIG. 7
FIG. 8
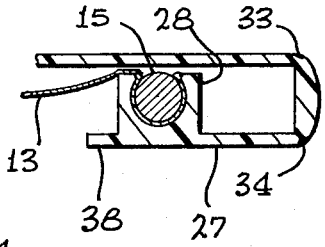

TRASH BAG CADDY

BACKGROUND OF THE INVENTION

1. Field of the Invention

This invention relates to trash containers and more particularly to a novel trash container or bag caddy which includes means for maintaining the entrance or mouth to the bag or container open during filling and includes means for supporting the bag or container on the ground employing detachable fastening means for connecting the various components of the caddy together as well as retaining or keeping the bag in place.

2. Brief Description of the Prior Art

In the past, it has been the conventional practice to store trash, debris, leaves or the like in storage and trash bags which are composed of a thin plastic film material so that the bag or container may be subsequently disposed of with its contents as a unitary assembly. In loading such a bag or container, it is difficult to place the trash or leaves inside the bag with one hand while holding the bag open with the other hand. Generally, during the loading procedure, leaves and trash fall outside the bag and require additional work to pick up and occasionally, the wind will blow the debris into other areas.

Some attempts have been made to provide openers for bags so that the entrance or mouth leading into the interior of the bag will remain open while the user employs both hands to place trash or leaves inside. Such prior attempts include clips, wire assemblies and other devices which generally require expensive assembly and are generally expensive to manufacture.

Therefore, a long standing need has existed to provide a releasable retainer or fastening means for detachably connecting the various components of the caddy together so that the entrance leading into a pliable trash bag will be retained open during the loading procedure. The caddy including the fastening means must be readily assembled and disassembled for storage or shipping purposes.

SUMMARY OF THE INVENTION

Accordingly, the above problems and difficulties are obviated by the present invention which provides a novel trash bag or container caddy having a rigid ring or hoop for supporting and holding the entrance of a trash bag open to receive leaves, trash or the like and wherein the ring or hoop is supported on the ground by leg members constituting a pair of U-shaped members having their center sections cross over at a right angle so that the free ends upwardly extend into detachable connection with portions of the ring or loop. Snap-lock fastening means are employed for detachably connecting the free ends of the leg members to the loop and such fastening means includes resilient sockets into which the leg members and the thickness of the hoop are disposed for retention. A circular fastening means including socket members is employed for securing the overlapped central portions of the leg members together and the socket members of the hoop and leg member connection fastening means also secures a portion of the bag to each of the leg members for positive retention.

Therefore, it is among the primary objects of the present invention to provide a novel trash bag caddy which may be readily assembled to hold a resilient, pliable trash bag open to receive contents during a loading procedure.

Another object of the present invention is to provide a member and ring construction for a trash bag caddy that may be readily assembled or disassembled employing a snap-lock fastening means for detachably connecting various components of the assembly together whereby the opening to a pliable trash bag will be maintained open during a loading procedure.

Still another object of the present invention is to provide a novel trash bag caddy which includes releasable retaining means for holding the mouth of the bag open during the loading procedure and wherein the retaining means may be employed for assembling or disassembling the caddy as desired.

Still a further object of the present invention is to provide a novel trash bag caddy or carrier which is simple in design and which may be readily used by unskilled personnel and which is relatively inexpensive to manufacture.

A further object of the present invention is to provide a trash bag carrier which may be termed as "knocked down" so that the assembly may be shipped or transported in a flat condition for assembly by the user at a desired location when the assembly may be readily achieved by unskilled personnel.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 3 is an enlarged side elevational view of a snap-lock fastening or retaining means used to assemble the carrier of caddy shown in FIGS. 1 and 2;

FIG. 4 is a transverse cross-sectional view of the retaining means shown in FIG. 3 as taken in the direction arrows 4—4 thereof;

FIG. 5 is a longitudinal cross-sectional view of a portion of the retaining means shown in FIG. 3 as taken in the direction of arrows 5—5 thereof;

FIG. 6 is a view similar to the view of FIG. 4 illustrating the connection of the mouth of the bag coupled into the caddy retaining means;

FIG. 7 is a front view of the retaining means and bag connection shown in FIG. 6;

FIG. 8 is a longitudinal cross-sectional view of the portion of the retainer shown in FIG. 5 in the attached position as shown in FIG. 7 as taken in the direction of arrows 8—8 thereof;

DESCRIPTION OF THE PREFERRED EMBODIMENT

Figure 1:
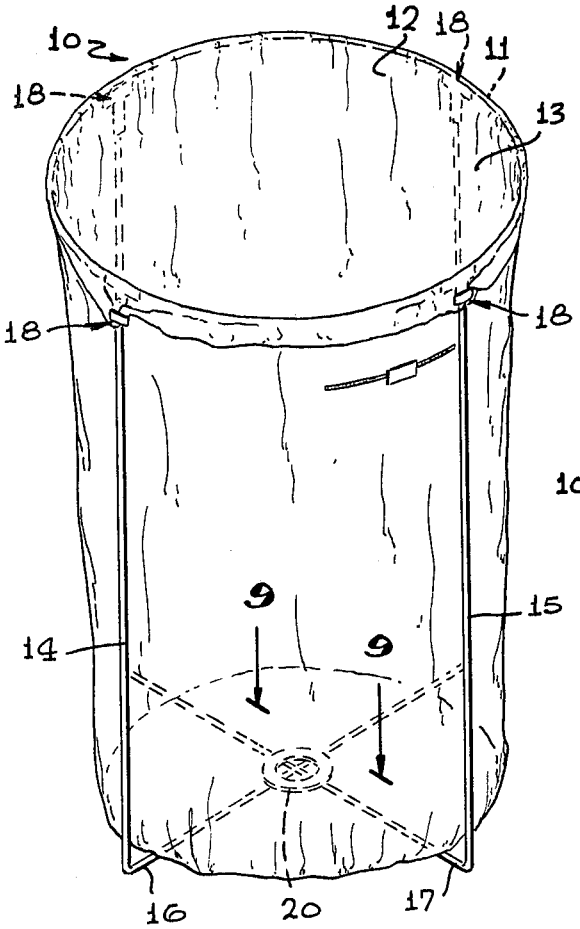
FIG. 1 is a perspective view showing the novel trash bag caddy or carrier incorporating the present invention.

Referring to FIG. 1, the novel trash bag caddy of the present invention is illustrated in the general direction of arrow 10 and includes a circular ring or hoop 11 which is composed of a rigid material such as metal rod. A trash container such as a bag 12 which is composed of a thin film-like plastic material and which is pliable and resilient is carried in a downwardly depending fashion from the ring or hoop 11. The mouth of the bag is indicated by numeral 13 and is open to receive trash, debris or the like when the mouth is folded over the hoop or ring 11 as will be described in greater detail later. The bag 12 is closed at its bottom end and open at its opposite end as indicated by numeral 13 forming an entrance or mouth to the interior of the container or bag.

Also included in the inventive concept and combination is a support means for supporting the trash bag in an upright fashion from a supporting structure such as the ground. The supporting structure may be a base comprising a pair of U-shaped leg members illustrated in general by the numerals 14 and 15 respectively. Each of the leg members 14 and 15 include a central section identified by numerals 16 and 17 respectively which are crossed over at their mid points at a right angle so that the upright leg sections of the members 14 and 15 will spread away from each and upwardly project to terminate in free ends adjacent to portions of the ring or hoop 11. At these respective portions, a retaining means, such as is indicated by numeral 18 is provided for detachably connecting each of the respective free ends of the leg sections to the hoop. Also, a portion of the retainer means clasps over a portion of the mouth 13 of the bag so that a positive retention for the bag is achieved. In order to maintain the leg members 14 and 15 in their respective positions during assembly and during insertion and withdrawal of the bag from the overall assembled frame, a circular ring retainer 20 detachably coupled the cross-over central portions of the sections 16 and 17.

Figure 2:
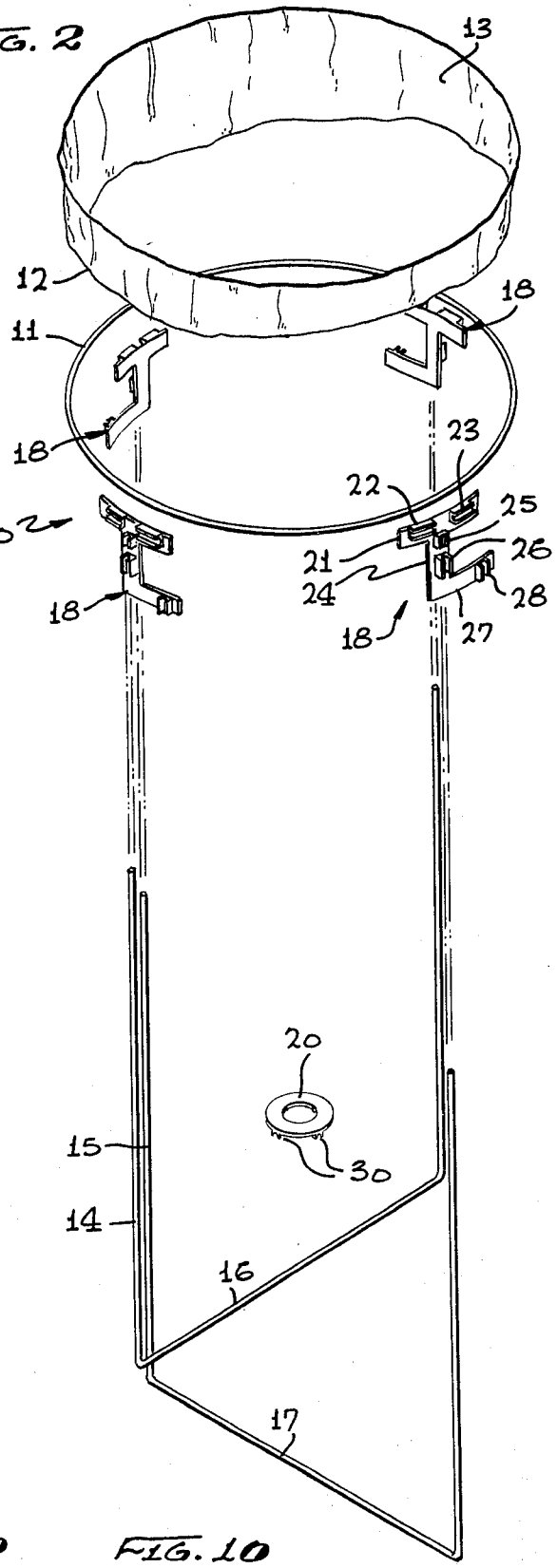
FIG. 2 is an exploded perspective view of the novel trash bag carrier shown in FIG. 1.
Figure 9:
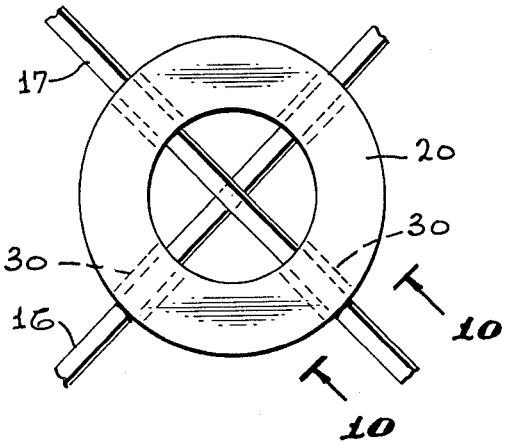
FIG. 9 is a top plan view of the circular snap-lock retaining means employed for connecting the cross over portions of the leg members together as taken in the direction of arrows 9—9 of FIG. 1.
Figure 10:
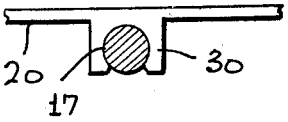
FIG. 10 is a transverse cross-sectional view of the circular retaining means taken in the direction of arrows 10—10 of FIG. 9.

Referring now in detail to FIG. 2, it can be seen that the retaining or fastening means 18 includes an elongated strip 21 carrying a pair of spaced apart resilient sockets 22 and 23 into which a portion of the ring or hoop 11 is insertably received. Downwardly depending from the strip 21 is a vertical body 24 that includes a pair of snap-lock sockets 25 and 26 which insertably receive the upper or terminating free end of one of the leg sections such as the leg section associated with U-shaped leg member 15. A bag retaining means is represented by a flexible strip 27 having a snap-lock socket 28 which is arranged to be folded over upon itself and snap-locked into retention with the leg section of the U-shaped leg member 15 with a portion of the bag mouth 13 tucked thereunder.

It is to be understood that the retainer or snap-lock means 18 is repeated in identical fashion for each of the remaining leg sections associated with the U-shaped leg members. Also, it is to be noted that the under surface of the circular retaining means 20 includes at least four snap-lock sockets, such as socket 30 for detachably engaging with the middle sections 16 and 17 associated with the U-shaped leg members.

Referring now in detail to FIG. 3, it can be seen that the ring 11 is received in a snap-lock fashion with the sockets 22 and 23. Also, rod leg member 15 is snap-locked into place with the resilient sockets 25 and 26. The terminating end of the rod leg member 15 is provided with integral lobes 31 and 32 carried on opposite sides of the rod and these lobes occupy a space between the spaced apart sockets 25 and 26. The provision of the lobes prevents the rod leg member 15 from sliding out of the sockets 25 and 26.

The retention strip 27 includes a pair of reduced thickness score lines 33 and 34 about which the strip is folded over upon itself when it is desired to capture a portion of the mouth of the bag 13 between the socket 28 and the rod leg member 15. As illustrated, the strip 27 is in its extended or unfolded position preparatory for folding over into retention with the leg member 15.

Referring now in detail to FIG. 4, it can be seen that the socket 23 as representative of all the sockets mentioned herein, includes a pair of outwardly projecting legs in spaced parallel relationship and that the legs include a reduced entrance leading to a circular groove adapted to be occupied by the rod or ring 11. The rod or ring is introduced thereto by insertion between the parallel legs and snapping into the groove.

In FIG. 5, a similar socket construction is illustrated for socket 28 wherein the groove is indicated by numeral 35 and the opposite parallel legs are indicated by numerals 36 and 37.

Referring now in detail to FIG. 6, the invention is illustrated and the retention means are shown in a manner similar to the showing of FIG. 4 with the addition of the bag 12 having the mouth 13 thereof folded over the ring 11 and retaining or securement means 18 so that a portion of the material of the bag is retained or captured in the snap-lock connection with socket 28. The strip 27 has been folded over upon itself and snapped over the rod leg member 15 to capture a portion of the bag therebetween.

As shown more clearly in FIG. 7, the strip 27 is folded about the scored lines such as score line 34 and the socket 28 is snapped into engagement with the rod 15 having a portion of the bag entrance 13 captured therebetween. The actual capturing is illustrated in FIG. 8 wherein the strip 27 is folded and the socket 28 engaged. A tab 38 is provided on the end of the strip 27 which will accommodate pulling the socket 28 out of engagement with the bag portion and the rod leg member 15. In order to disengage the other sockets with respect to ring 11 and leg member 15, it is only necessary to grasp the two parts in the user's hands and pull apart.

Therefore, it can be seen that the novel trash bag of the present invention provides a convenient and inexpensive means for the user to effectively load a trash bag by maintaining the entrance or mouth of the bag open preparatory to receiving trash, debris or the like. Initially in use, the mouth 13 of the bag 12 is opened and placed through the ring 11. The leg members 14 and 15 and crossed by the middle or central sections 16 and 17 and fastened together by the central retaining means 20. The body of the bag 12 is placed within the confines of the upright section of the leg members and sockets 22 and 23 are pressed into place against the ring 11 at the four indicated locations. The sockets 25 and 26 are similarly pressed into engagement with the rod leg members 15 and other rod leg members associated with the other three upright portions. Next, the mouth 13 of the bag is folded over the ring 11 and is carried exteriorly of the attachment means so that the strip 27 can be folded over upon itself via score lines 33 and 34 and socket 28 pressed into engagement with the rod leg member 15 capturing the mouth of the bag 14 therebetween.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A trash bag caddy comprising the combination of:

a trash bag composed of a pliable, resilient material having a tubular body closed at one end and open at its other end;

said bag having an edge marginal region at said open end defining an entrance leading into the interior of said bag;

a circular rigid ring disposed at said open end of said bag and said bag edge marginal region being folded over said ring so that said ring rigidizes said bag entrance;

a vertical supporting structure for said trash bag;

snap-lock socket means releasably interconnecting said supporting structure with said ring for releasably holding said bag therefrom in a fully supported manner;

said vertical supporting structure includes a pair of U-shaped leg members having central sections cross over upon themselves at a right angle;

said supporting structure further includes upright leg sections at each end of each of said central sections;

said socket means releasably engaging with the terminating ends of each of said upright leg sections; and a retaining socket means releasably engaged with said central sections at their cross-over point.

2. The invention as defined in claim 1 wherein:

said snap-lock socket means includes at least four fastening means, each of which comprises an elongated body having an upper strip integrally provided at one end and a pair of sockets carried thereon for insertably receiving a portion of said ring.

3. The invention as defined in claim 2 wherein:

said fastening means further includes a pair of spaced apart sockets carried on said body extending normal to said pair of sockets carried on said upper strip and being adapted to insertably receive said vertical supporting structure.

4. The invention as defined in claim 3 wherein:

said fastening means further includes a lower strip carried on the end of said body opposite to its end carrying said upper strip and said lower strip being flexible and having a retaining snap-lock socket carried on the free end of said lower strip adapted to insertably receive said vertical supporting structure leg sections a capturing and retention relationship with a portion of said trash bag entrance.

5. The invention as defined in claim 4 wherein:

said retaining socket means engaged with said central sections comprises a circular member having at least four sockets downwardly depending from the underside of said circular member for insertable reception with said central sections of said U-shaped leg members.

6. The invention as defined in claim 5 including:

a pair of lobes carried on each leg section of said U-shaped leg member in spaced relationship disposed between said body sockets.

7. The invention as defined in claim 6 wherein:

each of said sockets comprises a pair of projecting elements spaced apart and having a reduced opening leading into a receptacle constituting said socket.

* * * * *